US009515383B2

(12) United States Patent
Tchoffo Talom et al.

(10) Patent No.: US 9,515,383 B2
(45) Date of Patent: Dec. 6, 2016

(54) COMPACT ANTENNA STRUCTURE FOR SATELLITE TELECOMMUNICATIONS

(71) Applicant: THALES, Neuilly sur Seine (FR)

(72) Inventors: Friedman Tchoffo Talom, Gennevilliers (FR); Guillaume Fondi de Niort, Gennevilliers (FR); Sophia Thizon, Gennevilliers (FR)

(73) Assignee: THALES, Neuilly sur Seine (FR)

( * ) Notice: Subject to any disclaimer, the term of this patent is extended or adjusted under 35 U.S.C. 154(b) by 106 days.

(21) Appl. No.: 14/581,243

(22) Filed: Dec. 23, 2014

(65) Prior Publication Data

US 2015/0188231 A1 Jul. 2, 2015

(30) Foreign Application Priority Data

Dec. 26, 2013 (FR) ..... 13 03086

(51) Int. Cl.

| | |
|---|---|
| ***H01Q 9/04*** | (2006.01) |
| ***H01Q 21/30*** | (2006.01) |
| ***H01Q 1/28*** | (2006.01) |
| ***H01Q 21/06*** | (2006.01) |
| ***H01Q 5/378*** | (2015.01) |

(52) U.S. Cl.

CPC ..... *H01Q 9/0407* (2013.01); *H01Q 1/288* (2013.01); *H01Q 5/378* (2015.01); *H01Q 9/0414* (2013.01); *H01Q 9/0435* (2013.01); *H01Q 21/065* (2013.01); *H01Q 21/30* (2013.01)

(58) Field of Classification Search

CPC ..... H01Q 1/288; H01Q 5/378; H01Q 9/0407; H01Q 9/0414; H01Q 9/0435

See application file for complete search history.

(56) References Cited

U.S. PATENT DOCUMENTS

| | | | | |
|---|---|---|---|---|
| 5,798,734 A * | 8/1998 | Ohtsuka | ..... | H01Q 9/0414 343/700 MS |
| 5,905,465 A * | 5/1999 | Olson | ..... | H01Q 1/246 33/34 |
| 6,441,800 B1 | 8/2002 | Chan et al. | | |
| 6,864,853 B2 * | 3/2005 | Judd | ..... | H01Q 1/007 343/700 MS |

(Continued)

OTHER PUBLICATIONS

Daniel, J.P. et al. "Research on planar antennas and arrays: 'structures rayonnantes'," IEEE Antennas and Propagation Magazine, IEEE Service Center, Piscataway, NJ, US. vol. 35, No. 1, Feb. 1, 1993, pp. 14-38, XP011419857. ISSN: 1045-9243. DOI: 10.1109/74.210827.

(Continued)

*Primary Examiner* — Hoang V Nguyen

(74) *Attorney, Agent, or Firm* — Davidson, Davidson & Kappel, LLC

(57) ABSTRACT

An antenna structure for telecommunications is provided. The antenna structure may be particularly for satellite telecommunications. The antenna structure includes an emitting surface including at least one set of a plurality of elementary emitting antennas forming an array, at least one elementary emitting antenna including two generally circular patches that are at least partially superimposed, the at least one elementary emitting antenna being dimensioned to emit at least one electromagnetic wave having a frequency between 27 gigahertz and 31 GHz.

12 Claims, 10 Drawing Sheets

(56) References Cited

U.S. PATENT DOCUMENTS

| | | | | |
|---|---|---|---|---|
| 7,362,259 | B2 * | 4/2008 | Gottwald | H01Q 1/325 342/159 |
| 7,800,542 | B2 * | 9/2010 | Li | H01Q 1/3291 343/700 MS |
| 8,344,943 | B2 * | 1/2013 | Brown | G01S 7/03 342/147 |

OTHER PUBLICATIONS

Smith, D. et al. "Dual polarised microstrip antenna design for a polarisation shift keying microwave transponder," Microwave Conference, 1989. 19th European, IEEE, Piscataway, NJ, US, Sep. 4, 1989, pp. 149-154, XP031603282.

Sheng, Ye et al. "High-gain planar antenna arrays for mobile satellite communications [antenna applications corner]," IEEE Antennas and Propagation Magazine, IEEE Service Center, Piscataway, NJ, US, vol. 54, No. 6, Dec. 1, 2012, pp. 256-268, XP011494274, ISSN: 1045-9243, DOI: 10.1109/MAP.2012.6387841.

Garcia-Aguilar, A. et al. "Printed antenna for satellite communications," Phased Array Systems and Technology (Array), 2010 IEEE International Symposium on, IEEE, Piscataway, NJ, US, Oct. 12, 2010, pp. 529-535, XP031828623, ISBN: 978-1-4244-5127-2.

* cited by examiner

FIG.3
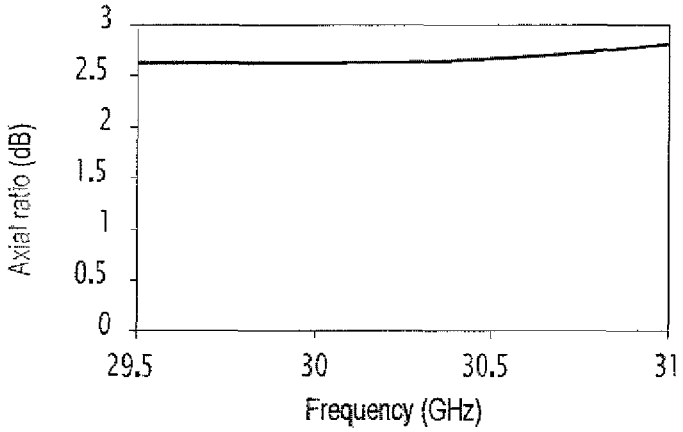
FIG.4
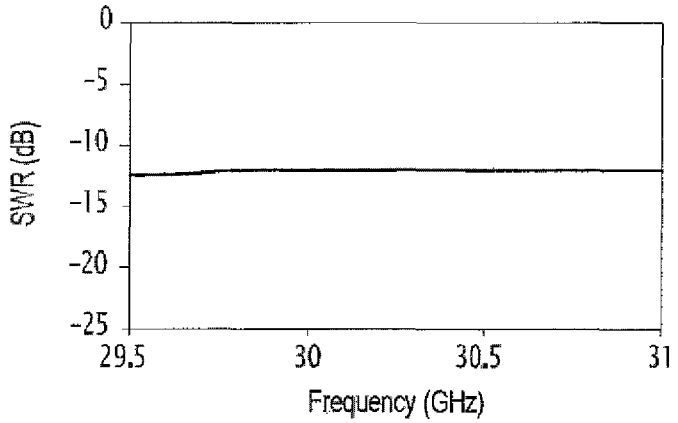
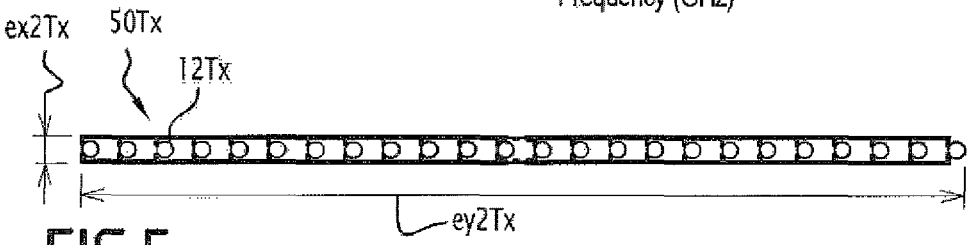
FIG.5
FIG.6
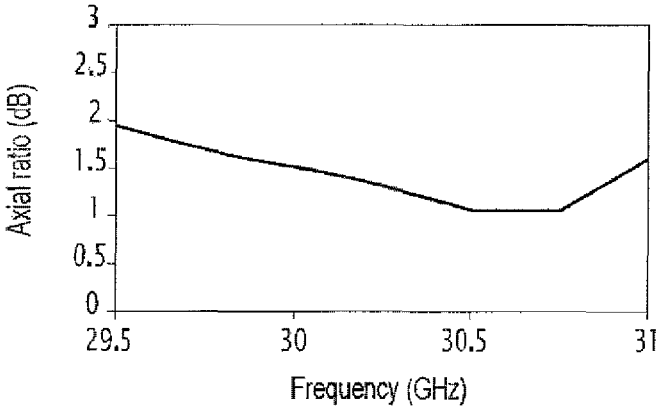

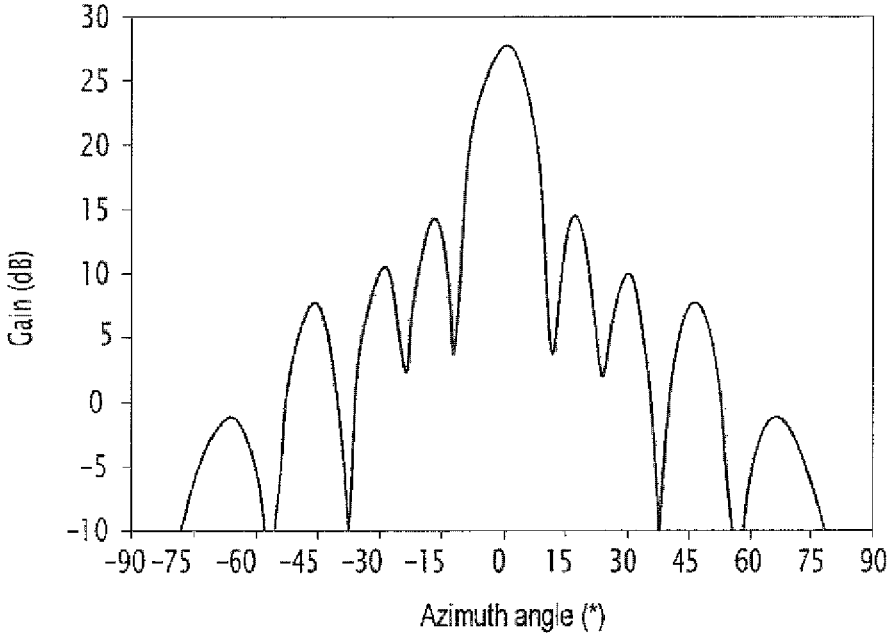
FIG.11
FIG.12
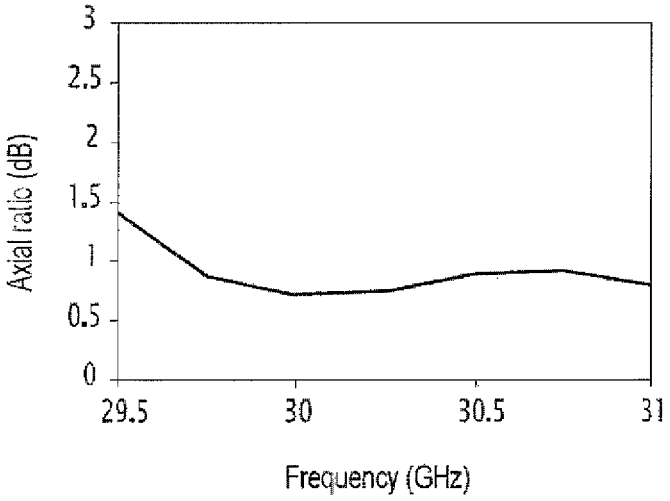

FIG.18
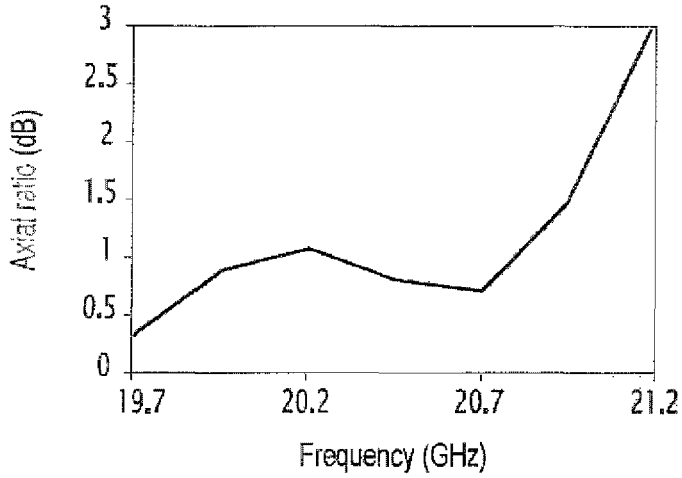
FIG.19
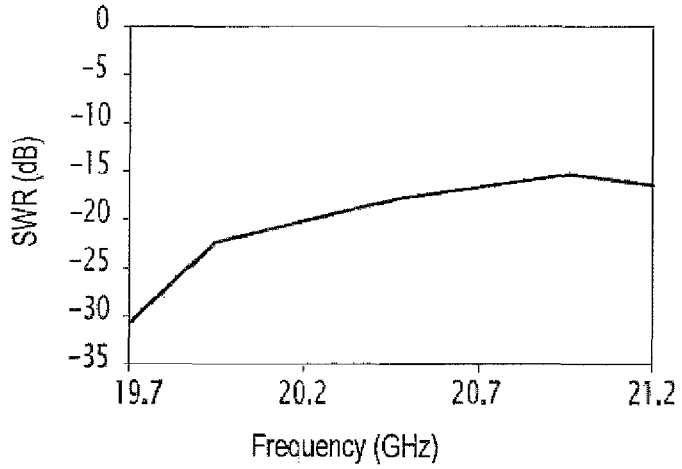
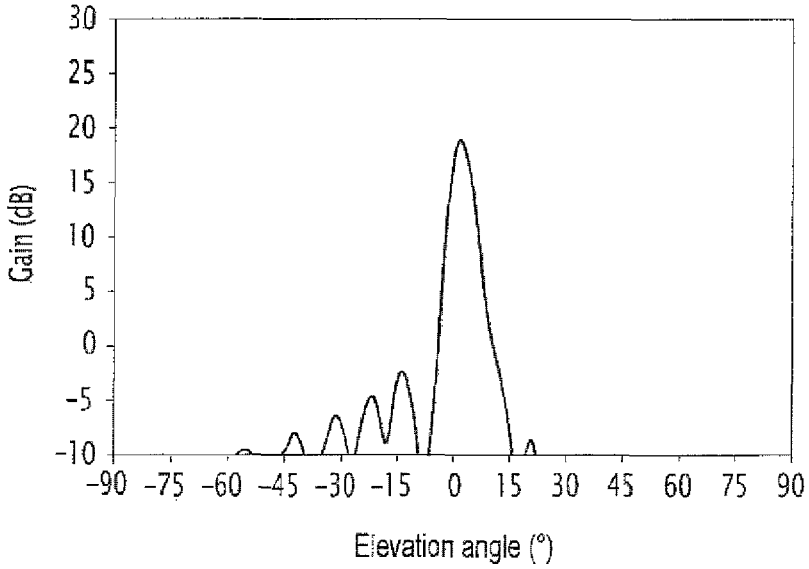
FIG.20

COMPACT ANTENNA STRUCTURE FOR SATELLITE TELECOMMUNICATIONS

Priority is hereby claimed to FR 13 03086 filed on Dec. 26, 2013, the entire disclosure of which is hereby incorporated by reference herein.

FIELD OF THE INVENTION

The present invention relates to an elementary antenna, a compact antenna structure for telecommunications comprising such an antenna, a platform comprising the antenna structure and a satellite communication method between two stations using the antenna structure.

BACKGROUND OF THE INVENTION

In the field of satellite communications, obtaining a high-quality communication involves particular performance for the electromagnetic waves produced by the antenna structure used in the communication in terms of gain and secondary lobe level (ratio between the intensity of the secondary lobes and the intensity of the primary lobe). This is even more true for so-called "broadband" satellite communications, i.e., not emitting only voice.

In the particular case of the Ka electromagnetic band, two separate frequency bands are involved. In fact, in emitting, the electromagnetic waves of the Ka band have a frequency comprised between 27 gigahertz (GHz) and 31 GHz, while in receiving, the electric waves of the Ka band have a frequency comprised between 17.3 GHz and 21.2 GHz. In the rest of the description, the Ka band for emitting is denoted Tx, while the Ka band for receiving is denoted Rx. Furthermore, the polarizations of the emitting and receiving waves are generally of the circular type, and may or may not be opposite.

These frequencies and these circular polarizations in receiving and emitting impose constraints on the antenna structure. Furthermore, in the context of satellite connections, the antenna should be oriented so as to aim at the satellite making it possible to establish the connection. Furthermore, to reduce the visual signature (physical bulk), parabolic antenna-type solutions are generally not favored. This is particularly true given that in that case, the depth of the antenna is constrained by the focal distance of the source illuminating the satellite dish.

Among the antenna structures making it possible to respect these various constraints, it is known to use an electronically-scanned antenna for the emitting of a wave whose central frequency is around 30 GHz and for the receiving of a wave centered around 20 GHz.

However, the electronically-scanned antenna obtained may have a significant bulk corresponding to the radiating surfaces of each of the operating modes (emitting/receiving). Furthermore, the efficiency of such an antenna may be insufficient based on the elementary antenna used and the associated power circuit, in particular when patch-type antennas are involved.

Furthermore, the implementation of a circular polarization in a first direction in the emitting part and a circular polarization in a second direction that may or may not be opposite the first direction for the receiving part proves difficult if a polarizer is used, which reduces the usage flexibility of the considered scanning antenna.

SUMMARY OF THE INVENTION

There is therefore a need for an antenna structure for telecommunications, in particular satellite in the Ka band, having a reduced bulk in terms of depth and aiming capacity while using an electronic scanning principle while also making it possible to obtain a good quality communication, in particular in terms of gain, axial ratio and secondary lobes compatible with normative templates.

The present invention provides, an antenna structure for telecommunications, in particular by satellite, comprising an emitting surface comprising at least one set of a plurality of elementary emitting antennas forming an array, at least one elementary emitting antenna comprising two generally circular patches that are at least partially superimposed, said at least one elementary emitting antenna being dimensioned to emit at least one electromagnetic wave having a frequency comprised between 27 gigahertz (GHz) and 31 GHz. The antenna structure also comprises a receiving surface comprising at least one set of a plurality of elementary receiving antennas forming an array, at least one elementary receiving antenna comprising two generally circular patches that are at least partially superimposed, said at least one elementary receiving antenna being dimensioned to receive at least one electromagnetic wave having a frequency comprised between 17.3 GHz and 21.2 GHz.

According to specific embodiments, the antenna structure may include one or more of the following features considered alone or according to all technically possible combinations:

- each patch of said at least one elementary emitting antenna has a center, said elementary emitting antenna comprising two power supply ports able to power one of the two patches, each port being in an angular sector having an angle relative to the center of the powered patch smaller than 180°, and/or each patch of said at least one elementary receiving antenna has a center, said elementary receiving antenna comprising two power supply ports able to power one of the two patches, each port being in an angular sector having an angle relative to the center of the powered patch smaller than 180°.
- the two patches of said at least one elementary emitting antenna are spaced apart in a first direction by a distance comprised between 0.5 millimeters (mm) and 2.0 mm, and/or the two patches of said at least one elementary receiving antenna are spaced apart in a first direction by a distance comprised between 0.5 millimeters (mm) and 2.0 mm.
- the two patches of said at least one elementary emitting antenna are spaced apart in a first direction by a distance comprised between 0.75 millimeters (mm) and 1.5 mm, and/or the two patches of said at least one elementary receiving antenna are spaced apart in a first direction by a distance comprised between 0.75 millimeters (mm) and 1.5 mm.
- the diameters of the two patches of said at least one elementary emitting antenna are identical, and/or the diameters of the two patches of said at least one elementary receiving antenna are identical.
- the elementary emitting antennas of the antenna structure all comprise two generally circular patches that are at least partially superimposed, each elementary emitting antenna being dimensioned to emit at least one electromagnetic wave having a frequency comprised between 27 GHz and 31 GHz, and/or the elementary receiving antennas of the antenna structure all comprise two generally circular patches that are at least partially superimposed, each elementary receiving antenna being dimensioned to receive at least one electromagnetic wave having a frequency comprised between 17.3 GHz and 21.2 GHz.

the elementary emitting antennas and the elementary receiving antennas are arranged in staggered rows.

the emitting surface is generally rectangular and comprises at least two sets of a plurality of elementary emitting antennas each forming an array, the elementary emitting antennas of each set being along a line specific to that set, each line being parallel to the other specific lines, and/or the receiving surface is generally rectangular and comprises at least two sets of a plurality of elementary receiving antennas each forming an array, the elementary receiving antennas of each set being along a line specific to that set, each line being parallel to the other specific lines.

Furthermore, the invention provides a platform, in particular aerial, comprising at least one antenna structure as previously described.

The present invention also provides a telecommunications method, in particular by satellite, between two stations comprising at least one of the following steps: a step for emitting electromagnetic waves having a frequency comprised between 27 GHz and 31 GHz by an antenna structure as previously described, and a step for receiving electromagnetic waves having a frequency comprised between 17.3 GHz and 21.2 GHz by an antenna structure as previously described.

BRIEF DESCRIPTION OF THE DRAWINGS

Other features and advantages of the invention will appear upon reading the following detailed description of embodiments of the invention, provided solely as an example and in reference to the drawings:

FIGS. 3 and 4 are graphs respectively showing the evolution of the axial ratio and the stationary wave ratio of the elementary antenna of FIG. 2 on the Tx band as a function of the operating frequency, FIG. 5 is a diagram of an array comprising a set of elementary antennas according to FIG. 2, FIGS. 6 and 7 are graphs showing the evolution of the axial ratio and the stationary wave ratio of the array of FIG. 5 as a function of the operating frequency.

FIGS. 10 and 11 are graphs showing the evolution of the gain of the panel of FIG. 9 as a function of the elevation angle and for a given azimuth angle, FIG. 12 is a graph showing the evolution of the axial ratio of the panel of FIG. 9 as a function of the operating frequency, FIG. 20 is a graph showing the evolution of the gain of the array of FIG. 17 as a function of the elevation angle.

DETAILED DESCRIPTION OF THE PREFERRED EMBODIMENTS

Figure 1:
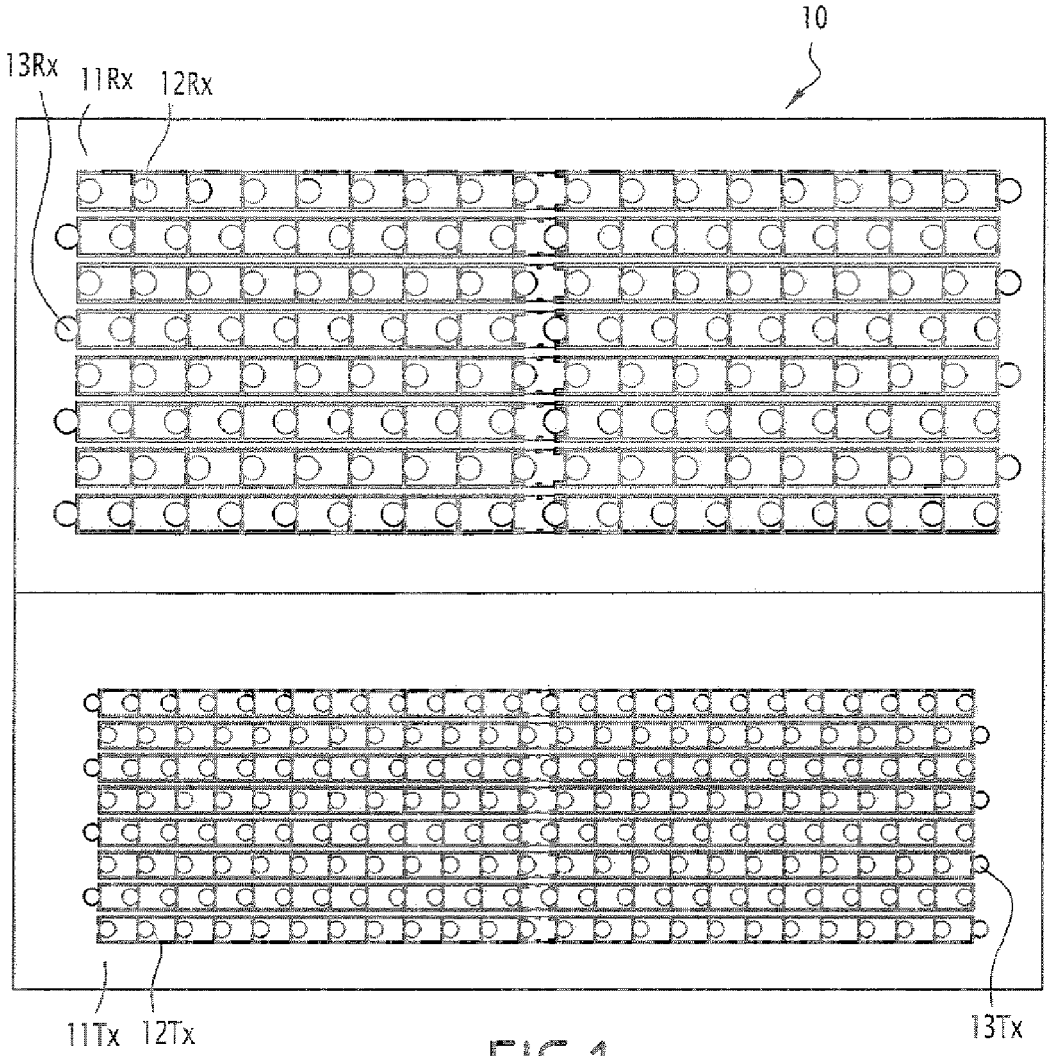
FIG. 1 is a diagram of an antenna structure able to work on the Ka band.

In the context of an application in telecommunications, in particular by satellite in the Ka band, an antenna structure 10 is proposed comprising an emitting surface 11*Tx* and a receiving surface 11*Rx* as shown in FIG. 1.

In the illustrated example, the emitting surface 11*Tx* has a generally rectangular shape and the receiving surface 11*Rx* also has a generally rectangular shape. Each emitting 11*Tx* and receiving 11*Rx* surface receives a plurality of elementary antennas 12*Tx* (for emitting) and 12*Rx* (for receiving).

The assembly of the emitting surface 11*Tx* and the plurality of elementary antennas 12*Tx* forms an emitting panel 13*Tx*, while the assembly of the receiving surface 11*Rx* and the plurality of elementary antennas 12*Rx* forms a receiving panel 13*Rx*.

Figure 2:
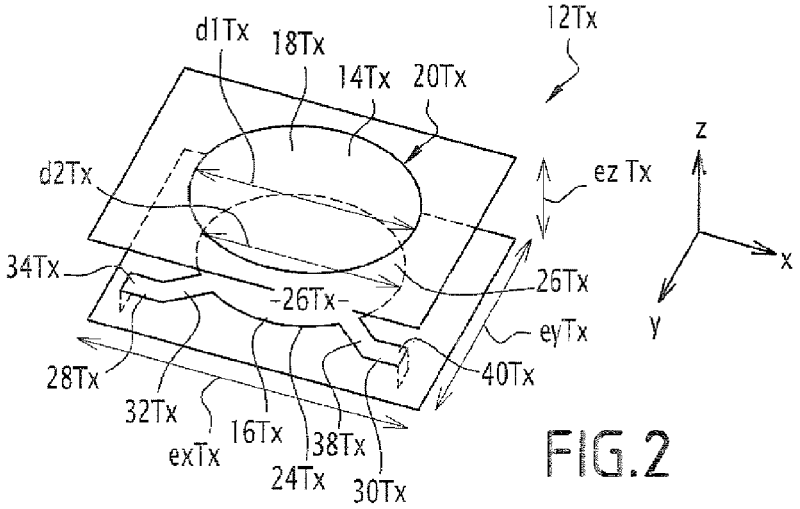
FIG. 2 is a perspective diagram of an elementary antenna working on the Tx band.

Hereinafter, the structure of the emitting panel 13*Tx* is outlined by successively describing an elementary antenna 12*Tx* for emitting (FIGS. 2 to 4), a line comprising a plurality of elementary antennas 12*Tx* for emitting (FIGS. 5 to 8), then the emitting panel 13*Tx* itself (FIGS. 9 to 13). An elementary antenna 12*Tx* for emitting is shown in FIG. 2. This means that the elementary antenna 12*Tx* is able to emit an electromagnetic wave whereof the wavelength is denoted $\lambda 0$, that wavelength $\lambda 0$ corresponding to a central frequency of the band comprised between 27 GHz and 31 GHz.

The elementary antenna 12*Tx* comprises two patches 14*Tx*, 16*Tx* that are at least partially superimposed.

Each patch 14*Tx*, 16*Tx* has a circular shape.

The first patch 14*Tx* comprises a first metallized layer 18*Tx* and a first insulating layer 20*Tx*, the first metallized layer 18*Tx* being arranged on the insulating layer 20*Tx*.

The first metallized layer 18*Tx* is therefore circular and has a first diameter d1*Tx*.

The shape of the first metallized layer 18*Tx* gives the first patch 14*Tx* a circular shape.

The second patch 16*Tx* also comprises a second metallized layer 22*Tx* and a second insulating layer 24*Tx*, the second metallized layer 22*Tx* being arranged on the second insulating layer 24*Tx*.

The second metallized layer 22*Tx* comprises a circular part 26*Tx* and two ports 28*Tx*, 30*Tx* for supplying current.

The circular part 26*Tx* has a circular shape and has a second diameter denoted d2*Tx*. The first port 28*Tx* comprises two first segments 32*Tx* and 34*Tx*, a first proximal segment 32*Tx* in contact with the circular part 26*Tx* and a first distal segment 34*Tx* relative to the circular part 26*Tx*.

The first proximal segment 32*Tx* is rectilinear and extends in a direction called first proximal direction. The first proximal segment 32*Tx* is normal relative to the portion of the circular part 26*Tx* with which the first proximal segment 32*Tx* is in contact.

The first distal segment 34*Tx* is rectilinear and extends in the extension of the proximal segment 32*Tx* in a direction called first distal direction. The first proximal and distal directions form an angle greater than 90° between them. Preferably, the angle between the first proximal direction and the first distal direction is comprised between 120° and 145°.

Likewise, the second port 30*Tx* comprises two second segments 38*Tx* and 40*Tx*, a second proximal segment 38*Tx* in contact with the circular part 26*Tx* and a second distal segment 40*Tx* relative to the circular part 26*Tx*.

The second proximal segment 38*Tx* is rectilinear and extends in a direction called second proximal direction. The second proximal segment 38*Tx* is normal relative to the portion of the circular part 26*Tx* with which the second proximal segment 38*Tx* is in contact.

According to the example of FIG. 2, the two proximal directions form an angle smaller than 180° between them. Thus, each port 28*Tx*, 30*Tx* is in an angular sector having an angle relative to the center of the circular part smaller than 180°.

In other words, the distance between the two ports 28*Tx* and 30*Tx* is smaller than 0.5*λ0 to make it possible to perform the aiming function by phase shift with the smallest possible deterioration of the secondary lobes in order to remain compatible with normalization templates. Preferably, the distance between the two ports 28*Tx* and 30*Tx* is smaller than or equal to 0.42*λ0.

The second distal segment 40*Tx* is rectilinear and extends in the extension of the second proximal segment 38*Tx* in a direction called second distal direction. The second proximal and distal directions form an angle greater than 90° between them. Preferably, the angle between the second proximal direction and the second distal direction is comprised between 120° and 145°.

The shape of the second metallized layer 22*Tx* gives the second patch 16*Tx* a generally circular shape such that it is considered, in a simplified manner hereinafter, that the second patch 16*Tx* has a circular shape.

Thus, it is in particular considered that the second diameter d2*Tx* of the circular part 26*Tx* is the diameter of the second patch 16*Tx*.

Preferably, the first diameter d1*Tx* and the second diameter d2*Tx* can be identical.

The two patches 14*Tx* and 16*Tx* are at least partially superimposed. This means that the two patches 14*Tx* and 16*Tx* are at least partially aligned in a first direction Z.

According to the particular example of FIG. 2, two patches 14*Tx* and 16*Tx* are superimposed. This means that the projection of the circular part 26*Tx* on the plane comprising the first metallized layer 18*Tx* is combined with the first metallized layer 18*Tx*.

Furthermore, the circular part 26*Tx* and the first metallized layer 18*Tx* are parallel. The two patches 14*Tx* and 16*Tx* are thus spaced apart in a first direction Z by a distance denoted ezTx.

Preferably, the spacing distance ezTx between the two patches 14*Tx* and 16*Tx* in the first direction Z is comprised between 0.5 millimeters (mm) and 2.0 mm. Advantageously, the spacing distance ezTx between the two patches 14*Tx* and 16*Tx* in the first direction Z is comprised between 0.75 mm and 1.5 mm.

In a manner known in itself, the spacing distance ezTx between the two patches 14*Tx* and 16*Tx* in the first direction Z, the diameter d1*Tx* and d2*Tx* of the patches 14*Tx* and 16*Tx* make it possible to determine the frequency or frequencies at which the elementary antenna 12*Tx* can emit.

The elementary antenna 12*Tx* is dimensioned to emit frequencies comprised between 27 GHz and 31 GHz (Tx band). This means that such an elementary antenna 12*Tx* has first and second diameters d1*Tx*, d2*Tx* comprised between 2.5 mm and 4 mm. The upper bound corresponds to the product of 0.4 by the wavelength a that the elementary antenna 12*Tx* is capable of emitting.

Alternatively, instead of a condition on the diameters d1*Tx*, d2*Tx*, a constraint is imposed on the geometry of the second patch 16*Tx*. The second patch 16*Tx* can be fitted into a rectangle whereof the extension exTx in a second direction X is comprised between 4.0 mm and 4.4 mm, and the extension eyTx in a third direction Y is comprised between 3.8 mm and 4.2 mm. The two directions X and Y are perpendicular to each other and to the first direction Z.

The performance of the elementary emitting antenna 12*Tx* will now be described in reference to FIGS. 3 and 4.

FIGS. 3 and 4 show that over the entire band of interest (in this case, the Tx band), the axial ratio and the stationary wave ratio (denoted using the corresponding acronym, SWR, in all of the figures in which this ratio appears for simplification purposes) are relatively low.

The elementary antenna 12*Tx* therefore has a wide band, i.e., a band 5% wider around the central operating frequency, with circular polarization and a very good efficiency of illumination (in particular the axial ratio for such a small antenna is better than in the state of the art and the apodization of the radiation pattern for the emitted wave is facilitated during networking).

It should be noted that in the illustrated embodiment, the two patches 14*Tx* and 16*Tx* are arranged such that the second metallic layer 22*Tx* faces the first insulating layer 20*Tx*.

Alternatively, the two patches 14*Tx* and 16*Tx* are arranged such that the second metallic layer 22*Tx* faces the first metallic layer 18*Tx*.

An array 50*Tx* has also been proposed as illustrated by FIG. 5, comprising a plurality of elementary antenna 12*Tx* for emitting.

According to the particular example of FIG. 5, the array 50*Tx* comprises twenty-four elementary antennas 12*Tx*.

In general, a combination of a larger number of elementary antennas 12*Tx* is possible based on the overall dimensions and desired performance, in particular in terms of the gain of the array 50*Tx*.

Each elementary antenna 12*Tx* of FIG. 5 is identical to the elementary antenna 12*Tx* described in reference to FIG. 2.

Alternatively, some antennas are different.

The elementary antennas 12*Tx* are arranged regularly along a line thus forming the array 50*Tx*. Furthermore, the elementary antennas 12*Tx* are connected to each other to form the array 50*Tx*. The connection is done by means of two rectilinear lines that ensure the power supply of the unit array. The array 50*Tx* thus formed for emitting has two ports that make it possible, based on the power supply, to radiate an electromagnetic wave in the desired frequency band using the desired circular polarization.

In the example of FIG. 5, the array 50*Tx* has an extension ex2*Tx* along the second direction X comprised between 4 mm and 6 mm. Preferably, the extension ex2*Tx* in the second direction X is comprised between 4.5 mm and 5.5 mm.

In the example of FIG. 5, the array 50*Tx* also has an extension ey2*Tx* in the third direction Y comprised between 160 mm and 190 mm. Preferably, the extension ey2*Tx* in the third direction Y is comprised between 165 mm and 185 mm.

During operation, each elementary antenna 12*Tx* of the array 50*Tx* is powered by an electromagnetic wave. Each elementary antenna 12*Tx* captures the electrical field coming from electromagnetic wave so that the array 50*Tx* emits a wave in the desired frequency band.

Figure 7:
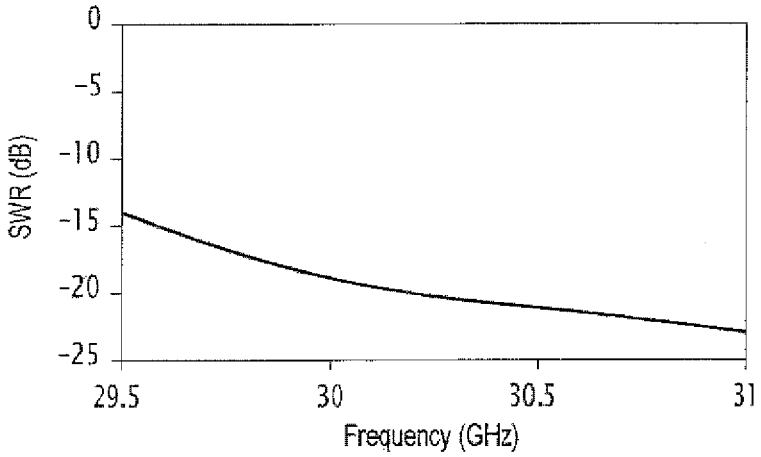

The performance in terms of axial ratio and stationary wave ratio and advantages imparted by the array 50*Tx* are similar to the performance and advantages imparted by the elementary antennas 12*Tx* of FIG. 2 as shown by studying FIGS. 6 and 7.

Figure 8:
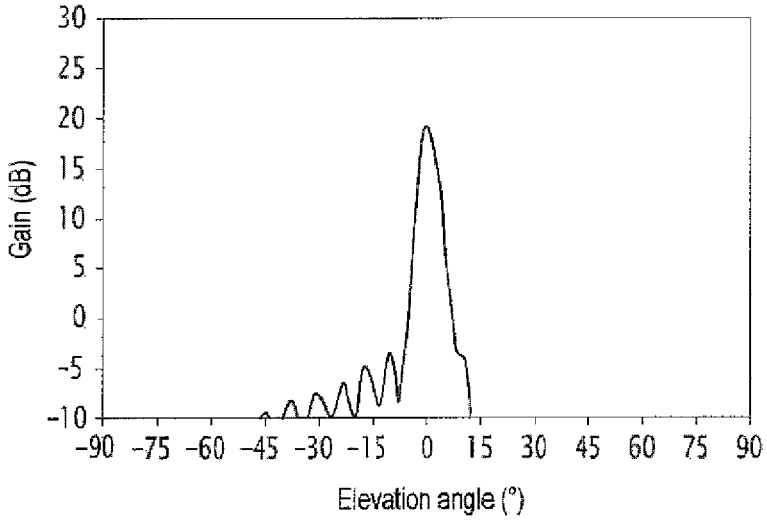
FIG. 8 is a graph showing the evolution of the gain of the antenna structure according to FIG. 5 as a function of the elevation angle.

Furthermore, FIG. 8 shows that the array 50*Tx* has a gain of approximately 20 dB, which attests to the good efficiency of illumination of the antenna structure in light of its dimensions, i.e., the extension ex2*Tx* in the second direction X and the extension ey2*Tx* in the third direction Y.

Figure 9:
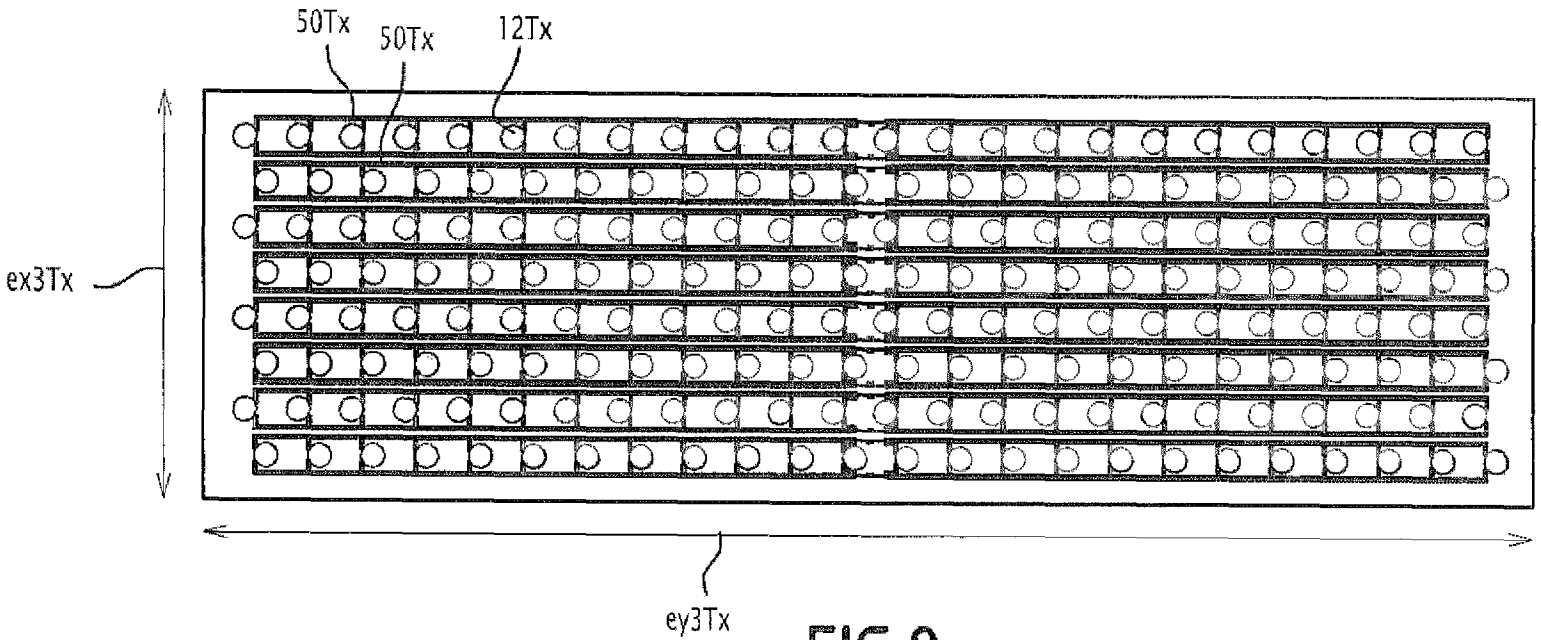
FIG. 9 is a diagram of a panel working on the Tx band and comprising arrays according to FIG. 5.

FIG. 9 illustrates the emitting panel 13*Tx* of FIG. 1. The elements identical to the embodiment of FIG. 5 are not described again. Only the differences are shown.

The emitting panel 13*Tx* comprises eight arrays 50*Tx* instead of a single array 50*Tx*.

In general, a combination of a larger number of arrays 50*Tx* is possible based on the overall dimensions and desired performance in particular in terms of gain and radiation opening.

In the case at hand, the number of antennas for the array 50*Tx* is chosen as a function of a dimensional constraint applied in the third direction Y.

Each array 50*Tx* is parallel to the other arrays 50*Tx*.

The elementary antennas 12*Tx* are arranged in staggered rows. Such an arrangement makes it possible to preserve the performance in terms of stability of the axial ratio during networking of the overall structure as well as during aiming by phase shift.

Furthermore, in the example of FIG. 9, the emitting panel 13*Tx* has an extension ex3*Tx* in the second direction X comprised between 40 mm and 50 mm. Preferably, the extension ex3*Tx* in the second direction X is comprised between 45 mm and 48 mm. The extension ex3*Tx* in the second direction X is connected to the number of array antennas 50*Tx* in question. In the case shown in FIG. 9, the extension ex3*Tx* in the second direction X corresponds to approximately nine times the size of an elementary antenna.

In the example of FIG. 9, the emitting panel 13*Tx* also has an extension ey3*Tx* in the third direction Y comprised between 160 mm and 190 mm. Preferably, the extension ey3*Tx* in the third direction Y is comprised between 165 mm and 185 mm. The extension ey3*Tx* in the third direction Y is related to the number of elementary antennas 12*Tx* in question.

The performance in terms of axial ratio and advantages imparted by the emitting panel 13*Tx* are similar to the performance and advantages imparted by the elementary antenna 12*Tx* of FIG. 2, as shown by studying FIG. 12.

Figure 10:
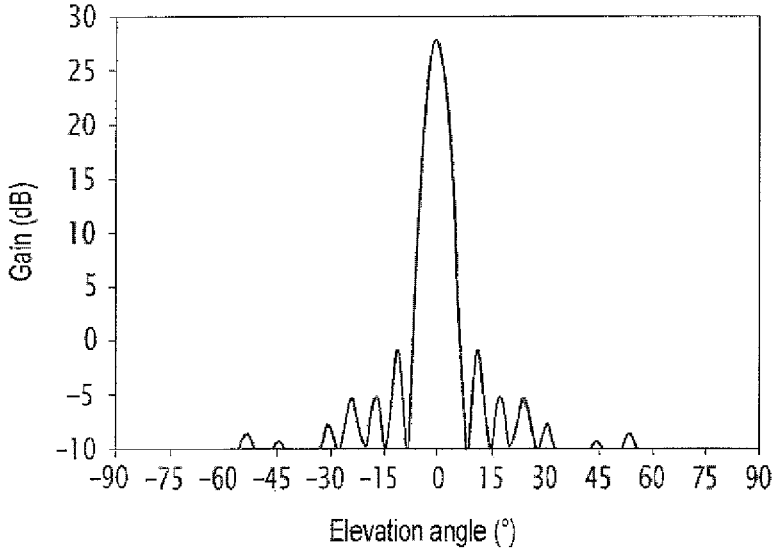

Furthermore, FIGS. 10 and 11 show that the emitting panel 13*Tx* has a gain of approximately 28 dB, which corresponds to an efficient compact antenna structure at the considered operating frequency.

Figure 13:
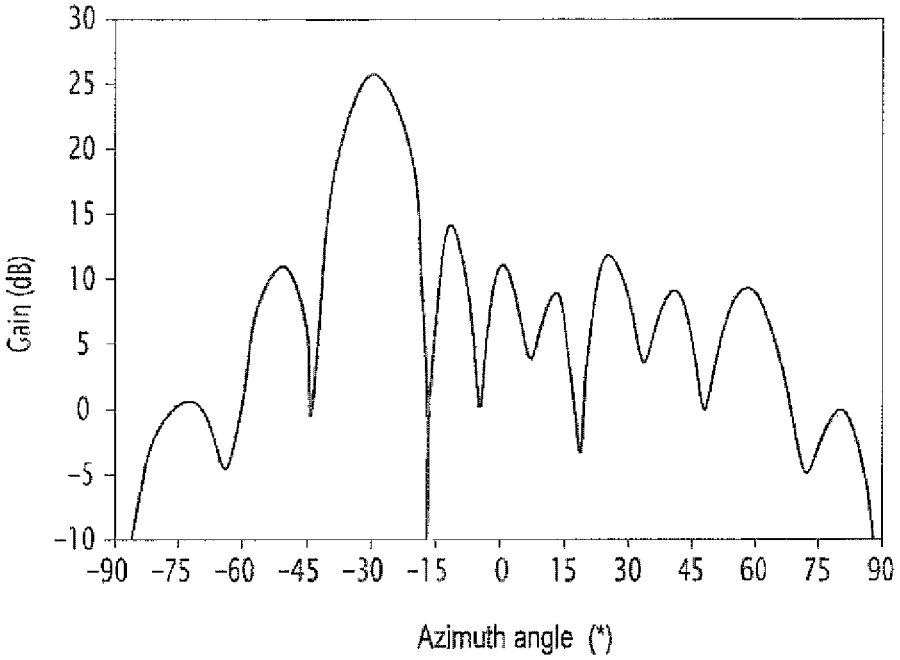
FIG. 13 is a graph showing the evolution of the gain of the panel of FIG. 9 as a function of the azimuth angle when a misalignment is implemented.

Furthermore, when a misalignment is done, it can be shown by comparing FIGS. 11 and 13 in particular that the gain of 26 dB is obtained in a relatively remote direction determined by an azimuth angle of 30°. The proposed emitting panel 13*Tx* is therefore robust with respect to misalignment with a very low rise of the secondary lobes.

Below, the structure of the receiving panel 13*Rx* of FIG. 1 is outlined by successively describing an elementary antenna 12*Rx* for receiving (FIGS. 14 to 16), a line comprising a plurality of elementary antennas 12*Rx* for receiving (FIGS. 17 to 20), then the receiving panel 13*Rx* itself (FIGS. 21 to 24).

Figure 14:
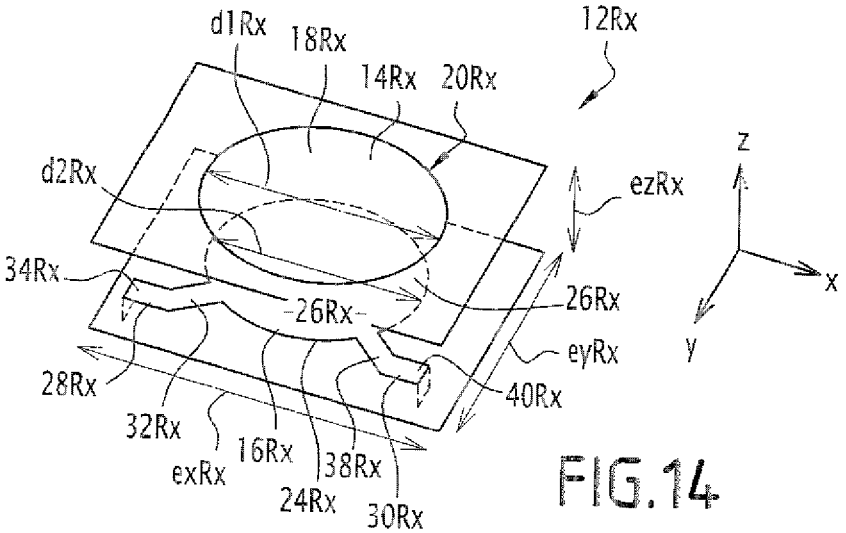
FIG. 14 is a perspective diagram of an elementary antenna operating on the Rx band.

FIG. 14 illustrates an elementary antenna 12*Rx* for receiving. The elements identical to the elementary emitting antenna 12*Tx* of FIG. 2 are not described again. Only the differences are shown.

The reference signs of the elements of the elementary receiving antenna 12*Rx* are followed by an Rx suffix instead of the Tx suffix for the corresponding elements of the elementary antenna 12*Rx*.

An elementary antenna 12*Rx* for receiving is shown in FIG. 14. This means that the elementary antenna 12*Rx* is able to receive an electromagnetic wave whose wavelength is denoted λ0, that wavelength λ0 corresponding to a frequency comprised between 17.3 GHz and 21.2 GHz.

Consequently, the elementary antenna 12*Rx* is dimensioned to receive frequencies comprised between 17.3 GHz and 21.2 GHz (Rx band). This means that such an elementary antenna 12*Rx* has first and second diameters d1*Rx*, d2*Rx* comprised between 4.5 mm and 7 mm.

Alternatively, instead of a condition on the diameters d1*Rx*, d2*Rx*, a constraint is imposed on the second patch 16*Rx*. The second patch 16*Rx* can then be fitted into a rectangle whereof the extension exRx in the second direction X is comprised between 6.6 mm and 7.0 mm and the extension eyRx in the third direction Y is comprised between 6.0 mm and 6.4 mm.

The receiving performance of the elementary antenna 12*Rx* will now be described in reference to FIGS. 15 and 16.

Figure 15:
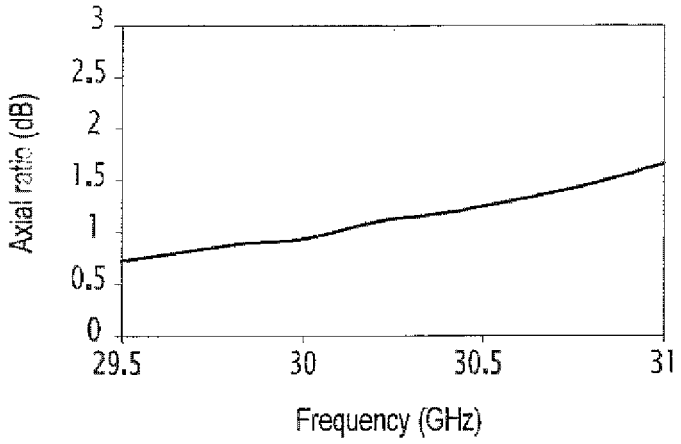
FIGS. 15 and 16 are graphs showing the evolution of the axial ratio and the stationary wave ratio for the elementary antenna of FIG. 14 on the Rx band as a function of the operating frequency.
Figure 16:
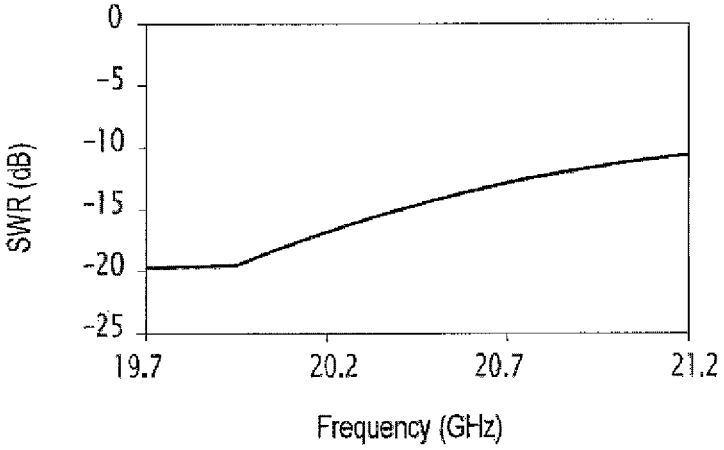

The performance and advantages imparted by the elementary receiving antenna 12*Rx* are similar to the performance and advantages imparted by the elementary emitting antenna 12*Tx*, as shown by studying FIGS. 15 and 16.

Figure 17:
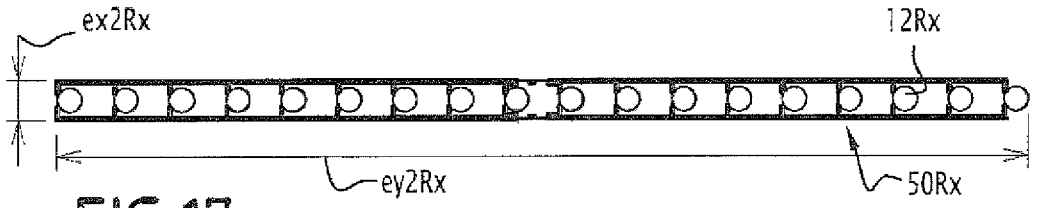
FIG. 17 is a diagram of an array comprising a set of elementary antennas according to FIG. 14, FIGS. 18 and 19 are graphs showing the evolution of the axial ratio and the stationary wave ratio of the array of FIG. 17 as a function of the operating frequency.

FIG. 17 illustrates an array 50*Rx* for receiving according to the invention. According to the specific example of FIG. 17, the array 50*Rx* comprises eighteen elementary antennas 12*Rx*.

In general, a combination of a larger number of elementary antennas 12*Rx* is possible based on the overall dimensions and desired performance, in particular in terms of the gain of the array 50*Rx*.

In the case at hand, the number of antennas for the array 50*Rx* is chosen as a function of a dimensional constraint applied in the third direction Y.

Each elementary antenna 12*Rx* of FIG. 17 is identical to the elementary antenna 12*Rx* described in reference to FIG. 14.

Alternatively, some antennas are different.

The elementary antennas 12*Rx* are arranged regularly along a line thus forming the array 50*Rx*. Furthermore, the elementary antennas 12*Rx* are connected to each other to form the array 50*Rx*. The connection is done by means of a rectilinear line that ensures the power supply of the unit array. The array 50*Rx* thus formed for receiving has two ports that make it possible, based on the power supply, to receive an electromagnetic wave in the desired frequency band using the desired circular polarization.

In the example of FIG. 17, the array 50*Rx* has an extension ex2*Rx* in the second direction X comprised between 6 mm and 8.5 mm. Preferably, the extension ex2*Rx* in the second direction X is comprised between 7.6 mm and 8.0 mm.

In the example of FIG. 17, the array 50*Rx* also has an extension ey2*Rx* in the third direction Y comprised between 180 mm and 200 mm. Preferably, the extension ey2*Rx* in the third direction Y is comprised between 185 mm and 195 mm. The extension ey2*Rx* in the third direction Y is related to the number of elementary antennas 12*Rx* in question.

The performance in terms of axial ratio and stationary wave ratio and advantages imparted by the array 50*Rx* are similar to the performance and advantages imparted by the elementary antennas 12*Rx* according to the example of FIG. 14 as shown by studying FIGS. 18 and 19.

Furthermore, FIG. 20 shows that the array 50*Rx* has a gain of approximately 18 dB, which corresponds to an efficient compact antenna structure at the considered operating frequency.

Figure 21:
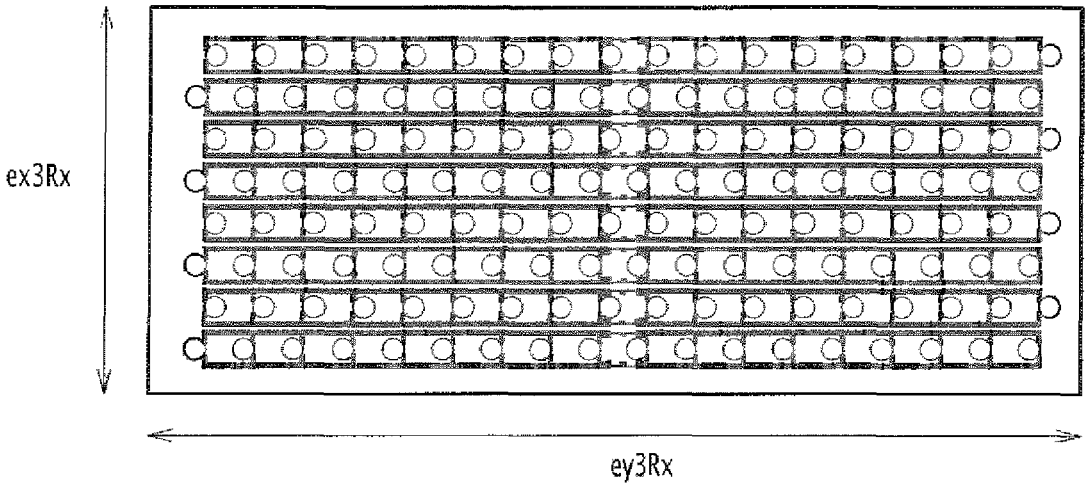
FIG. 21 is a diagram of a panel working on the Rx band and comprising arrays according to FIG. 17.

FIG. 21 illustrates the receiving panel 13*Rx* of FIG. 1. The elements identical to the embodiment of FIG. 17 are not described again. Only the differences are shown.

The receiving panel 13*Rx* comprises eight arrays 50*Rx* instead of a single array 50*Rx*.

In general, a combination of a larger number of arrays 50*Rx* is possible based on the overall dimensions and desired performance in particular in terms of gain and radiation opening.

Each array 50*Rx* is parallel to the other arrays 50*Rx*.

The elementary antennas 12*Rx* are arranged in staggered rows. Such an arrangement makes it possible to preserve the performance in terms of stability of the axial ratio during networking of the overall structure as well as aiming by phase shift.

Furthermore, in the example of FIG. 21, the receiving panel 13*Rx* has an extension ex3*Rx* in the second direction X comprised between 60 mm and 80 mm. Preferably, the extension ex3*Rx* in the second direction X is comprised between 65 mm and 75 mm. The extension ex3*Rx* in the second direction X is related to the number of arrays 50*Rx* in question.

In the example of FIG. 21, the receiving panel 13*Rx* also has an extension ey3*Rx* in the third direction Y comprised between 190 mm and 210 mm. Preferably, the extension ey3*Rx* in the third direction Y is comprised between 195 mm and 205 mm. The extension ey3*Rx* in the third direction Y is related to the number of elementary antennas 12*Tx* in question.

Figure 22:
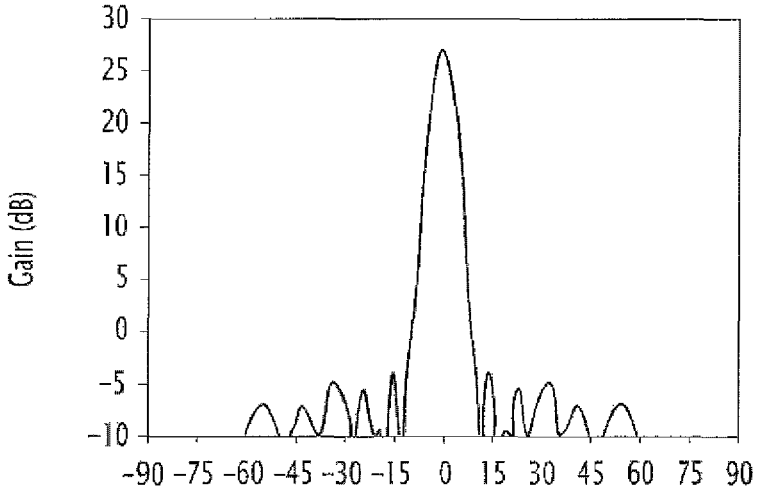
FIGS. 22 and 23 are graphs showing the evolution of the gain of the panel of FIG. 21 as a function of the elevation angle and the azimuth angle, respectively.
Figure 23:
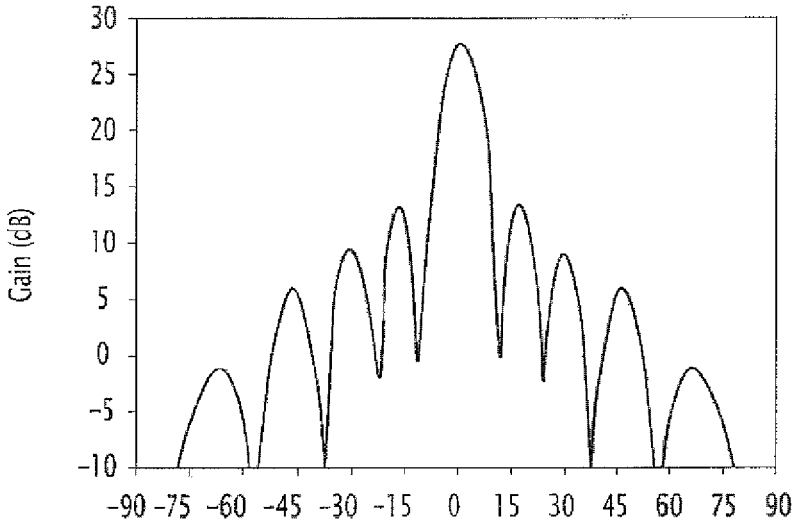
Figure 24:
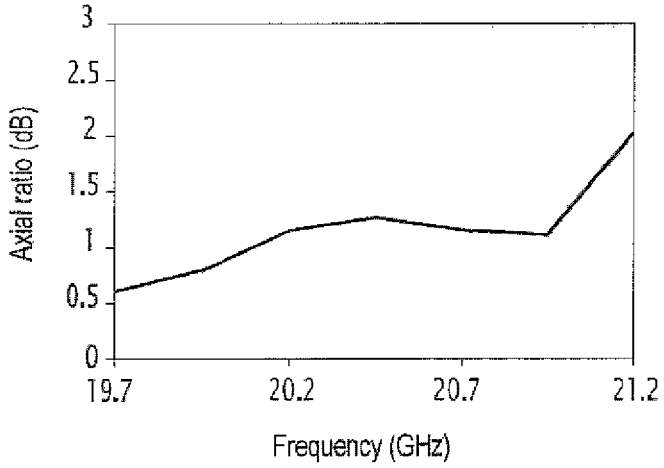
FIG. 24 is a graph showing the evolution of the axial ratio of the panel of FIG. 21 as a function of the operating frequency.

The performance in terms of axial ratio and gain and advantages imparted by the receiving panel 13*Rx* are similar to the performance and advantages imparted by the panel 50*Rx* of FIG. 17, as shown by studying FIGS. 22 to 24.

In all of the embodiments, because the elementary antenna 12 has a wide band, circular polarization and good efficiency of illumination, the antenna structure 10 has a reduced bulk and a reduced weight relative to the antenna structures of the state of the art for identical radiation performance. This reduced weight makes it possible to reduce the constraints in particular in the case where the entire antenna is accompanied by a mechanical positioner.

Furthermore, the production of this antenna structure 10 on a single-layer substrate makes it possible to insert easily, on the rear side at the ground plane, with the least amount of stress and impact on the radiation performance, the coupler, power supply and phase shift devices to ensure monitoring and polarization choice as well as phase law and amplitude making it possible to orient the radiation pattern in the desired direction in the electronic scanning configuration.

The antenna structure 10 is also capable of emitting or receiving circularly polarized electromagnetic waves without using an additional polarizer. This better compactness is accompanied by improved lightness and improved radiation performance over a wide frequency band compatible with the targeted application. Furthermore, the antenna structure 10 is easy to produce and can be manufactured at a low cost.

Thus, the proposed antenna structure 10 is usable for telecommunications applications between two stations, in particular by satellite. It should be noted that in that case, the radiation pattern of the antenna structure 10 thus produced complies with the templates specified to be used with certain satellites.

Such an antenna structure 10 can advantageously be used in a platform, in particular aerial of the helicopter or drone type. In the context of that use, the compactness of the antenna structure 10 makes it possible to reduce the constraints on installations of equipment in the platform.

The antenna structure 10 described in reference to FIG. 1 is an example of an antenna structure 10 having the compactness properties previously described. Other similar antenna structures 10 can also be considered, in particular with a different number of elementary receiving 12*Rx* and/or emitting 12*Tx* antennas and a different arrangement thereof.

These different antenna structures 10 are antenna structures for telecommunications, in particular by satellite, having a reduced bulk in terms of depth and aiming capacities using an electronic scanning principle while making it possible to obtain a high-quality high-bandwidth communication, in particular in terms of gain, axial ratio and secondary lobes compatible with normative templates.

What is claimed is:

1. An antenna structure for telecommunications comprising:

an emitting surface comprising at least one set of a plurality of elementary emitting antennas forming an array, at least one elementary emitting antenna comprising two generally circular patches that are at least partially superimposed, the at least one elementary emitting antenna being dimensioned to emit at least one electromagnetic wave having a frequency comprised between 27 GHz and 31 GHz, and a receiving surface comprising at least one set of a plurality of elementary receiving antennas forming an array, at least one elementary receiving antenna comprising two generally circular patches that are at least partially superimposed, said at least one elementary receiving antenna being dimensioned to receive at least one electromagnetic wave having a frequency comprised between 17.3 GHz and 21.2 GHz.

2. The method according to claim 1, wherein:

each patch of said at least one elementary emitting antenna has a center, said elementary emitting antenna comprising two power supply ports able to power one of the two patches, each port being in an angular sector having an angle relative to the center of the powered patch smaller than 180°, or each patch of said at least one elementary receiving antenna has a center, said elementary receiving antenna comprising two power supply ports able to power one of the two patches, each port being in an angular sector having an angle relative to the center of the powered patch smaller than 180°.

3. The antenna structure according to claim 1, wherein:
the two patches of said at least one elementary emitting antenna are spaced apart in a first direction by a distance comprised between 0.5 millimeters and 2.0 mm, and/or
the two patches of said at least one elementary receiving antenna are spaced apart in a first direction by a distance comprised between 0.5 millimeters and 2.0 mm.

4. The antenna structure according to claim 1, wherein:
the two patches of said at least one elementary emitting antenna are spaced apart in a first direction by a distance comprised between 0.75 millimeters and 1.5 mm, or
the two patches of said at least one elementary receiving antenna are spaced apart in a first direction by a distance comprised between 0.75 millimeters and 1.5 mm.

5. The antenna structure according to claim 1, wherein:
diameters of the two patches of said at least one elementary emitting antenna are identical, or
diameter of the two patches of said at least one elementary receiving antenna are identical.

6. The antenna structure according to claim 1, wherein:
the elementary emitting antennas of the antenna structure comprise two generally circular patches that are at least partially superimposed, each elementary emitting antenna being dimensioned to emit at least one electromagnetic wave having a frequency comprised between 27 GHz and 31 GHz, or
the elementary receiving antennas of the antenna structure all comprise two generally circular patches that are at least partially superimposed, each elementary receiving antenna being dimensioned to receive at least one electromagnetic wave having a frequency comprised between 17.3 GHz and 21.2 GHz.

7. The antenna structure according to claim 1, wherein the elementary emitting antennas and the elementary receiving antennas are arranged in staggered rows.

8. The antenna structure according to claim 1, wherein:
the emitting surface is generally rectangular and comprises at least two sets of a plurality of elementary emitting antennas each forming an array, the elementary emitting antennas of each set being along a line specific to that set, each line being parallel to other specific lines, or
the receiving surface is generally rectangular and comprises at least two sets of a plurality of elementary receiving antennas each forming an array, the elementary receiving antennas of each set being along a line specific to that set, each line being parallel to the other specific lines.

9. The antenna structure according to claim 1, wherein the telecommunications are satellite telecommunications.

10. A platform comprising at least one antenna structure according to claim 1.

11. The platform according to claim 10, wherein the platform is an aerial platform.

12. A telecommunications method, between two stations comprising the steps of:
emitting electromagnetic waves having a frequency comprised between 27 GHz and 31 GHz via an antenna structure according to claim 1; or receiving electromagnetic waves having a frequency comprised between 17.3 GHz and 21.2 GHz via an antenna structure according to claim 1.

* * * * *